US007976187B2

(12) United States Patent
Villard

(10) Patent No.: US 7,976,187 B2
(45) Date of Patent: Jul. 12, 2011

(54) UNIFORM INTENSITY LED LIGHTING SYSTEM

(75) Inventor: Russell G. Villard, Apex, NC (US)

(73) Assignee: Cree, Inc., Durham, NC (US)

( * ) Notice: Subject to any disclaimer, the term of this patent is extended or adjusted under 35 U.S.C. 154(b) by 6 days.

(21) Appl. No.: 12/056,851

(22) Filed: Mar. 27, 2008

(65) Prior Publication Data

US 2009/0244893 A1 Oct. 1, 2009

(51) Int. Cl.
*F21V 9/00* (2006.01)

(52) U.S. Cl. ..... 362/246; 362/800; 362/612; 362/613; 362/249.02; 362/249.11

(58) Field of Classification Search ..... 362/800, 362/246, 612, 613, 249.01, 249.02, 249.11
See application file for complete search history.

(56) References Cited

U.S. PATENT DOCUMENTS

| | | | | |
|---|---|---|---|---|
| 1,675,731 | A | 7/1928 | Schofield | |
| 1,791,718 | A | 2/1931 | Dye et al. | |
| 3,892,959 | A * | 7/1975 | Pulles | 362/613 |
| 5,890,794 | A * | 4/1999 | Abtahi et al. | 362/294 |
| 5,921,652 | A * | 7/1999 | Parker et al. | 362/601 |
| D428,516 | S | 7/2000 | Reo et al. | |
| D430,339 | S | 8/2000 | Reo | |
| D437,446 | S | 2/2001 | Reo et al. | |
| 6,238,065 | B1 | 5/2001 | Jones | |
| D443,949 | S | 6/2001 | DiMonte | |
| 6,932,599 | B1 * | 8/2005 | Hartung | 433/29 |
| 7,097,339 | B2 * | 8/2006 | Chou et al. | 362/612 |
| 7,213,940 | B1 | 5/2007 | Van de ven et al. | |
| 7,290,906 | B2 * | 11/2007 | Suzuki et al. | 362/511 |
| 2001/0050852 | A1 | 12/2001 | Jones | |
| 2002/0080602 | A1 | 6/2002 | Jones | |
| 2003/0053314 | A1 | 3/2003 | Summerford et al. | |

FOREIGN PATENT DOCUMENTS

| | | |
|---|---|---|
| DE | 29501661 U1 | 10/1995 |
| EP | 0684425 B1 | 11/1995 |
| GB | 183274 | 7/1922 |

OTHER PUBLICATIONS

U.S. Appl. No. 11/613,714, filed Dec. 20, 2006.
U.S. Appl. No. 11/614,180, filed Dec. 21, 2006.
U.S. Appl. No. 11/624,811, filed Jan. 19, 2007.
U.S. Appl. No. 11/736,761, filed Apr. 18, 2007.
U.S. Appl. No. 11/736,799, filed Apr. 18, 2007.
U.S. Appl. No. 11/751,982, filed May 22, 2007.
U.S. Appl. No. 11/751,990, filed May 22, 2007.
U.S. Appl. No. 11/753,103, filed May 24, 2007.

(Continued)

*Primary Examiner* — Anabel M Ton
(74) *Attorney, Agent, or Firm* — Jenkins, Wilson, Taylor & Hunt, P.A.

(57) ABSTRACT

Light emitting device multi-chip lighting fixtures are disclosed. According to one aspect, a lighting fixture is provided, the lighting fixture having a plurality of light-emitting devices operable for emitting light onto a light diffuser. Where each of the light-emitting devices produces light having a non-uniform luminous intensity, each of the light-emitting devices is positioned with respect to one another to illuminate the surface of the light diffuser with an aggregate light having a substantially uniform luminous intensity. In this way, the light cast by the lighting fixture appears to have a substantially uniform luminous intensity.

31 Claims, 2 Drawing Sheets

OTHER PUBLICATIONS

U.S. Appl. No. 11/843,243, filed Aug. 22, 2007.
U.S. Appl. No. 11/870,679, filed Oct. 11, 2007.
U.S. Appl. No. 11/936,163, filed Nov. 7, 2007.
U.S. Appl. No. 60/990,435, filed Nov. 27, 2007.
U.S. Appl. No. 11/948,021, filed Nov. 30, 2007.
U.S. Appl. No. 11/951,626, filed Dec. 6, 2007.
U.S. Appl. No. 12/017,676, filed Jan. 22, 2008.
U.S. Appl. No. 12/056,851, filed Mar. 27, 2008.
U.S. Appl. No. 12/116,346, filed May 7, 2008.
U.S. Appl. No. 12/116,348, filed May 7, 2008.
U.S. Appl. No. 12/117,122, filed May 8, 2008.
U.S. Appl. No. 12/117,131, filed May 8, 2008.
U.S. Appl. No. 12/117,148, filed May 8, 2008.
U.S. Appl. No. 12/117,271, filed May 8, 2008.
Focal Point Web Material, "Focal Point® launches two dimensions of popular Sky™ family", date: 2002, p. 1.
Focal Point Web Matieral, "Sky™ 2×2", date: 2002, p. 1.
Foal Point literature, "Sky™ 2×2", pp. 116-117.
Focal Point literature, "Sky™ 4×4", pp. 118-199.
International Search Report and Written Opinion dated Jul. 16, 2008.

* cited by examiner

UNIFORM INTENSITY LED LIGHTING SYSTEM

TECHNICAL FIELD

The subject matter described herein relates to semiconductor light emitting devices. More particularly, the subject matter described herein relates to multiple light emitting device chips housed in a lighting fixture.

BACKGROUND

Despite being based on a technology that has not changed substantially in decades, incandescent lamps remain the most widely-used source of in-home lighting. It is thought that this prevalence is due largely to the preference of many people to the warm, yellowish light given off by the incandescent lamps and the relative inexpensiveness of the lights compared to other technologies. Incandescent lights create light by running electricity through a thin filament. The resistance of the filament to the flow of electricity causes the filament to heat to a very high temperature, which produces visible light. Because 98% of the energy input into an incandescent lamp is emitted as heat, however, the process is highly inefficient. Thus, although incandescent lighting is inexpensive and accepted, there has been a push for more efficient lighting technology.

In some applications, particularly in office buildings and retail stores, incandescents have been largely replaced by fluorescent lamps. Fluorescent lamps work by passing electricity through mercury vapor, which in turn produces ultraviolet light. The ultraviolet light is absorbed by a phosphor coating inside the lamp, causing it to produce visible light. This process produces much less heat than incandescent lights, but some energy is still lost creating ultraviolet light only to be converted into the visible spectrum. Further, the use of mercury vapor, even at the low levels present in most fluorescent bulbs, poses potential health and environmental risks.

Solid-state lighting is another alternative technology that could potentially displace incandescent lighting in many applications. In particular, light-emitting semiconductor devices, such as light-emitting diodes (LEDs), produce visible light by the electroluminescence of a semiconductor material in response to an electrical current. This process creates visible light with fewer inefficient energy losses, such as heat generation. In addition, light-emitting devices can be highly durable, generally have a life expectancy that is many times that of either incandescent or fluorescent lights, and their relatively small size allows them to be used in a wide variety of configurations.

Despite these advantages, however, light-emitting devices have not yet been widely accepted in the marketplace as a replacement for other forms of lighting. In combination with the relatively higher cost of the technology presently, this slow rate of acceptance is further thought to be a result of the fact that light-emitting devices produce light in a different way than either incandescent or fluorescent lights. Specifically, the light produced by light-emitting devices is highly directional, meaning that the light emitted tends to be rather focused in a particular direction. Thus, the technology is naturally suited for use in flashlights and other unidirectional applications, but it is not readily configurable to distribute uniform lighting to a wide area.

For example, previous attempts to create LED lighting fixtures have generally involved providing a planar array of LEDs. Although such arrays provide ample lighting, the light emitted tends to appear non-uniform because of "hot spots" of light intensity corresponding to each of the LEDs in the array. In addition, no light is cast behind the array, effectively creating a spotlight effect. As a result, it is thought that many individuals would not consider such fixtures because they would not provide the same kind of light as the incandescent lights to which they have become accustomed.

Accordingly, there exists a long-felt need for light-emitting device multi-chip lighting fixtures that provide an efficient alternative to incandescent and fluorescent lamps, but which also provide omni-directional lighting that has a substantially uniform luminous intensity in all directions.

SUMMARY

According to the present disclosure, novel light-emitting device multi-chip lighting fixtures are provided for emitting light having a substantially uniform luminous intensity across the surface of the lighting fixtures.

It is therefore an object of the present disclosure to provide light-emitting device multi-chip lighting fixtures having a light diffuser, with a plurality of light-emitting devices operable to emit non-uniform light in a direction toward the surface of the light diffuser. Each non-uniform light illuminates the surface with a non-uniform luminous intensity, but the aggregate of all the non-uniform lights at the surface of the light diffuser is transmitted through the light diffuser for emission of a light of a substantially uniform luminous intensity.

More particularly, it is an object of the present disclosure to provide a light-emitting diode (LED) lighting fixture including a light diffuser having a first surface and a second surface opposing the first surface and a plurality of LEDs operable to emit non-uniform light in a direction toward the first surface of the light diffuser, each of the non-uniform lights having a non-uniform luminous intensity. The LEDs are positioned with respect to one another so that the plurality of LEDs serves to illuminate the first surface of the light diffuser with an aggregate light having a substantially uniform luminous intensity and the aggregate light passes through the light diffuser and out from the second surface to provide a substantially uniform luminous intensity light emission from the lighting fixture.

An object having been stated above, and which is achieved in whole or in part by the subject matter disclosed herein, other objects will become evident as the description proceeds when taken in connection with the accompanying drawings as best described hereinbelow.

BRIEF DESCRIPTION OF THE DRAWINGS

Preferred embodiments of the subject matter described herein will now be explained with reference to the accompanying drawings of which.

DETAILED DESCRIPTION

Figure 1:
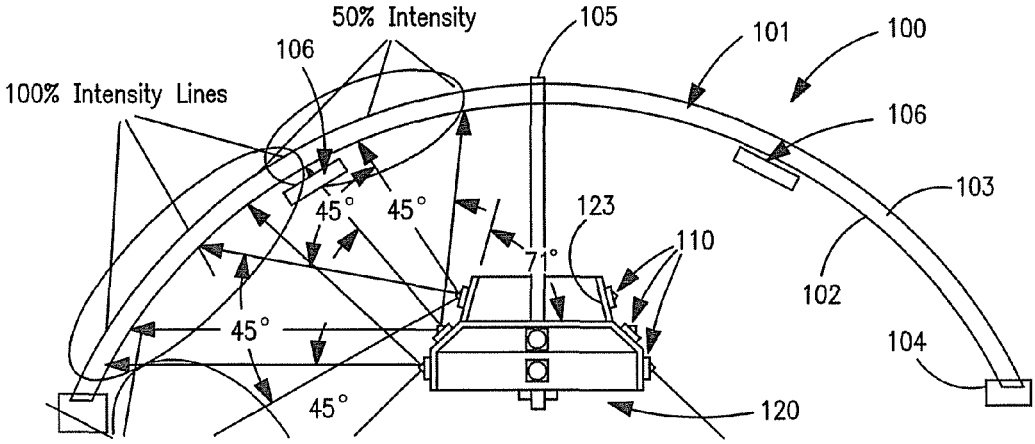
FIG. 1 is a vertical cross-sectional view of a lighting fixture according to an embodiment of the subject matter disclosed herein.

Light emitting device multi-chip lighting fixtures are described herein with reference to FIGS. 1-4. As illustrated in FIGS. 1-4, some sizes of structures or portions may be exaggerated relative to other structures or portions for illustrative purposes and, thus, are provided to illustrate the general structures of the subject matter disclosed herein. Further, various aspects of the subject matter disclosed herein are described with reference to a structure or a portion being formed on other structures, portions, or both. As will be appreciated by those of skill in the art, references to a structure being formed "on" or "above" another structure or portions contemplates that additional structure, portion, or both may intervene. References to a structure or a portion being formed "on" another structure or portion without an intervening structure or portion are described herein as being formed "directly on" the structure or portion.

Furthermore, relative terms such as "on" or "above" are used herein to describe one structure's or portion's relationship to another structure or portion as illustrated in the Figures. It will be understood that relative terms such as "on" or "above" are intended to encompass different orientations of the device in addition to the orientation depicted in the Figures. For example, if the device in the Figures is turned over, structure or portion described as "above" other structures or portions would now be oriented "below" the other structures or portions. Likewise, if the device in the Figures is rotated along an axis, structure or portion described as "above" other structures or portions would now be oriented "next to" or "left of" the other structures or portions. Like numbers refer to like elements throughout.

According to one aspect of the subject matter disclosed herein, a multi-chip lamp source assembly is provided that can be housed within a lighting fixture, the lighting fixture including at least two light emitting devices. As noted above, the light emitted from a light-emitting device is generally highly directional. Accordingly, each of the light emitting devices included in the lighting fixture emits a non-uniform light having a non-uniform luminous intensity. By specifically positioning the light emitting devices, however, the non-uniform light emitted by the multiple light emitting devices can be aggregated to produce a substantially uniform distribution of light intensity. In addition, a light diffuser can be provided to further distribute the emitted light to create the appearance of a uniform luminous intensity across the surface of the light diffuser.

As used herein, the term "light emitting device" may include an LED, laser diode, and/or other semiconductor device which includes one or more semiconductor layers, which may include silicon, silicon carbide, gallium nitride and/or other semiconductor materials, a substrate which may include sapphire, silicon, silicon carbide and/or other microelectronic substrates, and one or more contact layers which may include metal and/or other conductive layers. The design and fabrication of semiconductor light emitting devices is well known to those having skill in the art and need not be described in detail herein. For example, the semiconductor light emitting device may be gallium nitride-based LEDs or lasers fabricated on a silicon carbide substrate such as those devices manufactured and sold by Cree, Inc. of Durham, N.C., although other light emitting devices from other material systems may also be used.

FIG. 1 is a cross-sectional side view of a lighting fixture, generally designated 100, according to an embodiment of the subject matter described herein. Referring to FIG. 1, disclosed is a lighting fixture 100 including a light diffuser 101 and a plurality of light-emitting devices 110, such as LEDs. The light diffuser has a first surface 102 and a second surface 103 opposite first surface 102. Each of light-emitting devices 110 is operable to emit a non-uniform light in a direction toward first surface 102 of light diffuser 101. Despite this individual non-uniformity, light-emitting devices 110 can be positioned with respect to one another to illuminate first surface 102 of light diffuser 101 with an aggregate light having a substantially uniform luminous intensity. In this way, the aggregate light passes through light diffuser 101 and out from second surface 103, effectively providing the same illumination as a single omni-directional light source.

In addition, light-emitting devices 110 can be oriented with respect to one another to simulate an incandescent light. Because of the directionality of many light-emitting devices, lighting fixture 100 can be designed to illuminate only those areas that need to be seen. In contrast, standard incandescent lights provide omni-directional illumination, and thus surfaces behind the lighting fixture are illuminated as well as surfaces towards which the lighting fixture is directed. For example, for a lighting fixture that is suspended from the ceiling of a room, a typical incandescent light will cast at least some light on the ceiling. Although this upward illumination could be considered unnecessary and wasteful, many individuals have become accustomed to this effect and expect their lighting fixtures to perform in this manner. As a result, at least some of light-emitting devices 110 can be oriented such that light is emitted behind lighting fixture 100. In this way, at least some light can be cast upon the surface to which the lighting fixture is mounted (e.g., ceiling, wall), further simulating the appearance of a uniform, omni-directional light source.

The positioning of individual light-emitting devices 110 with respect to each other that will produce a substantially uniform aggregate light at least partly depends on the viewing angle of light-emitting devices 110, which can vary widely among different devices. For example, typical commercially-available LEDs can have a viewing angle as low as about 10 degrees, but some can have a viewing angle as high as about 180 degrees. This viewing angle not only affects the spatial range over which a single light-emitting device 110 can emit light, but it is closely tied with the overall brightness of the light-emitting device. Generally, the larger the viewing angle, the lower the brightness. Accordingly, light-emitting devices 110 having a viewing angle that provides a sufficient balance between brightness and light dispersion is thought to be desirable for use in lighting fixture 100.

Figure 2:
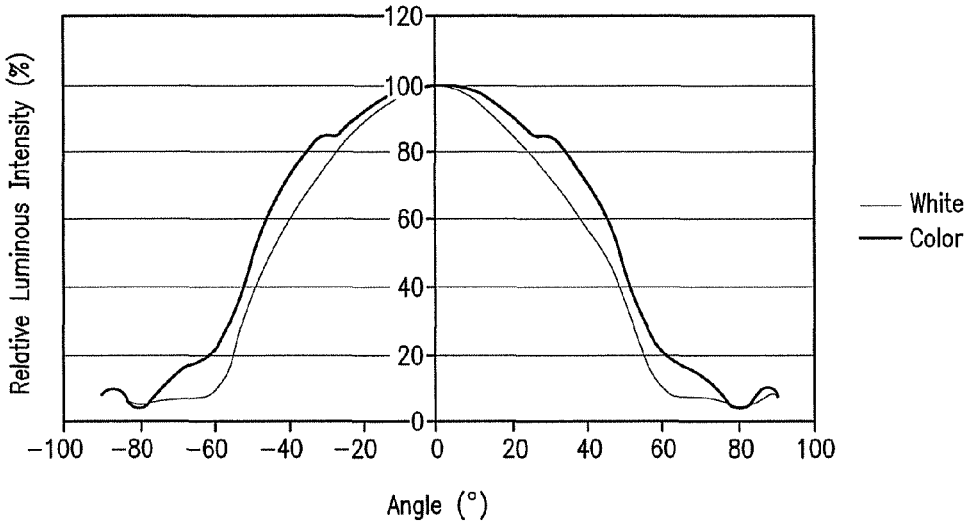
FIG. 2 is a graph showing a typical spatial distribution of relative luminous intensity for a light-emitting diode (LED)

In addition, as is shown in FIG. 2, a point along the central focus line of an LED can receive the full luminous intensity of light-emitting device 110, but the relative luminous intensity drops off as the angle from this central focus line increases. This property of LEDs can be commonly observed in both white and color LEDs (see FIG. 2). In this way, as noted above, arrays of LEDs often produce a light distribution that has "hot spots" of light intensity corresponding to each of the LEDs, with the space in between appearing dimmer. Accordingly, for plurality of light-emitting devices 110 having a given viewing angle, each of light-emitting devices 110 should be specifically positioned to disperse their respective non-uniform lights to eliminate such hot spots and create an aggregate light having a substantially uniform luminous intensity.

For instance, referring again to FIG. 2, light-emitting device 110 having a viewing angle of approximately 90 degrees (full width at half maximum) produces a maximum luminous intensity along a central focus line, but the relative luminous intensity of light emitted decays to 50 percent at approximately 45 degrees from this central focus line. Accordingly, if two of light-emitting devices 110 are directed toward first surface 102 of light diffuser 101 with the angles of their respective central focus lines differing by less than 90 degrees, the partial luminous intensity of the peripheral light emissions can be at least partially combined to create an aggregate light having a substantially uniform luminous intensity.

In addition, one other factor that should be considered when orienting light-emitting devices is the inverse-square law, which states that the intensity of light radiating from a point source is inversely proportional to the square of the distance from the source. For instance, an object twice as far away receives only one-fourth the energy. This physical law can be applied advantageously in the context of the present subject matter to further contribute to the emission of a light having a substantially uniform luminous intensity. Specifically, each of light-emitting devices 110 can be oriented such that the light having the highest intensity emitted from each of light-emitting devices 110 (i.e., along the central focus line) must travel farther to illuminate first surface 102 of light diffuser 101 than the light emitted peripherally. In this way, the relatively higher intensity of the light emitted along the central focus is diminished at first surface 102.

By way of specific example, light diffuser 101 as illustrated in FIG. 1 has a curved (e.g. domed) shape, with first surface 102 having a concave profile facing light-emitting devices 110 and second surface 103 having a convex profile facing away from light-emitting devices 110. Further, the curved shape is provided such that the outermost edges 104 of light diffuser 101 are farther away from light-emitting devices 110 than the center 105 of light diffuser 101. In this configuration, the central focus of at least a subset of light-emitting devices 110 can be directed towards outermost edges 104 such that the emissions from light-emitting devices 110 having the highest luminous intensity must travel farther to illuminate first surface 102 of light diffuser 101 than peripheral emissions. As a result, the variable luminous intensity of light emitted from light-emitting devices 110 can produce a substantially uniform distribution of light intensity.

Lighting fixture 100 can further include one or more secondary diffusers 106 positioned between light-emitting devices 110 and first surface 102 of light diffuser 101. Secondary diffusers 106 can be incorporated to further disperse relatively high-intensity light emissions to help create a substantially uniform distribution of light across light diffuser 101. For instance, secondary diffusers 106 can be positioned in line with the central focus of one or more of light-emitting devices 110 to eliminate any hot spots that are not softened by the orientation of light-emitting devices 110 and aggregation of light emitted therefrom.

Figure 3:
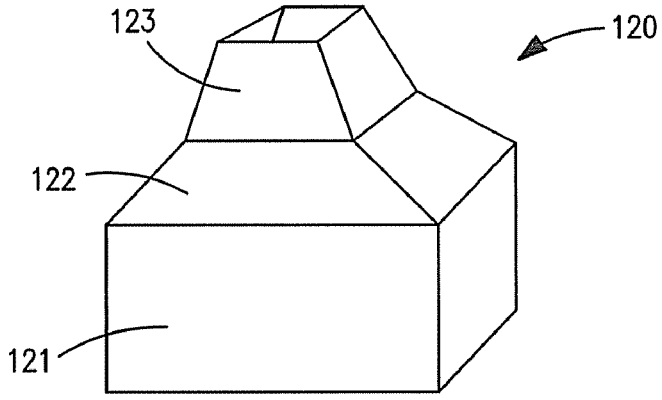
FIG. 3 is a perspective view of a lighting module according to the subject matter described herein.

Referring again to FIG. 1, lighting fixture 100 can further include a lighting module 120, with at least some of light-emitting devices 110 being positioned on lighting module 120. The shape of lighting module 120 can be specifically contoured to direct each of light-emitting devices 110 toward light diffuser 101 at a predetermined angle to produce the substantially uniform aggregate light. As noted above, the predetermined angles depend largely on the characteristics of the light-emitting device 110 selected, and therefore the contour of lighting module 120 likewise depends on the light-emitting devices 110 secured thereto. For example, as is depicted in FIG. 3, lighting module 120 can include a plurality of perpendicular first faces 121. A first series of light-emitting devices 110 can be positioned on first faces 121 to emit light outwardly towards outermost edges 104 of light diffuser 101. FIG. 3 further illustrates angled second faces 122 extending from first faces 121. The angle at which second faces 122 slope away from first faces 121 can be selected based on the viewing angle of light-emitting devices 110. For instance, for light-emitting devices 110 having a viewing angle of 90 degrees, second faces 122 can be inclined at approximately 45 degrees relative to first faces 121. In this configuration, a minimum number of light-emitting devices 110 can be provided to provide at least some substantially uniform light over a wide area.

Further still, angled third face or faces 123, illustrated in FIG. 1, can be provided extending from second faces 122 at a different angle relative to first faces 121 (See FIG. 3). Light-emitting devices 110 positioned on third face 123 can thereby direct light toward light diffuser 101 at yet another angle to help create an aggregate light having a substantially uniform luminous intensity. The angle at which third face 123 extends from second faces 122 can be predetermined and fixed, or third face 123 can be moveable (e.g., pivotable) such that the angle can be adjusted by the manufacturer, installer, or user. As a result, the orientation of light-emitting devices 110 positioned on third face 123 can be adjusted to change the distribution of light.

In addition, positioning lighting module 120 substantially at the center of lighting fixture 100 beneath light diffuser 101 allows lighting fixture 100 to further simulate the appearance of a standard incandescent light. In this position, any localized high-intensity hot spots will appear to the observer to come from the center of lighting fixture 100. As a result, such a pattern of lighting will help to create the illusion that lighting fixture 100 contains a single incandescent bulb.

To account for the heat generated by a plurality of light-emitting devices 110 within a lighting fixture 100, a heat sink or other means for energy dissipation can be provided. For instance, each of light-emitting devices 110 can be thermally coupled to an exterior heat sink. Alternatively, lighting module 120 can serve as a heat sink to dissipate heat from light-emitting devices 110. In instances where lighting module 120 does not itself provide sufficient heat dissipation surface area, lighting module 120 can further include additional structures, such as fins (not shown), extending from lighting module 120 to increase the heat dissipation surface area. In addition, light diffuser 101 can be advantageously configured such that air can flow around outermost edges 104 and/or through an opening (not shown) in light diffuser 101 at center 105 to help passively cool light-emitting devices 110 and any heat sink.

When using lighting module 120 as a heat sink, the material from which lighting module 120 is constructed can be specifically selected to help dissipate heat from light-emitting devices 110. For example, one material that can be used to provide both structural support and heat dissipation is aluminum. Specifically, lighting module 120 can be constructed from 6061 structural aluminum (e.g., 1/16" to 1/8" thick), which has a thermal conductivity of approximately 160-175 W/m·K. Of course, the thermal conductivity of copper is greater (approximately 400 W/m·K), but aluminum is less expensive and lighter in weight, providing advantages in both manufacture and installation. Steel, which is widely used in lighting fixtures, is a less expensive alternative to aluminum that can also be used to construct lighting module 120, but the thermal conductivity of steel (typically less than 50 W/m·K) is substantially less than that of aluminum. As a result, if steel is used, greater heat sink surface area may be required.

Figure 4:
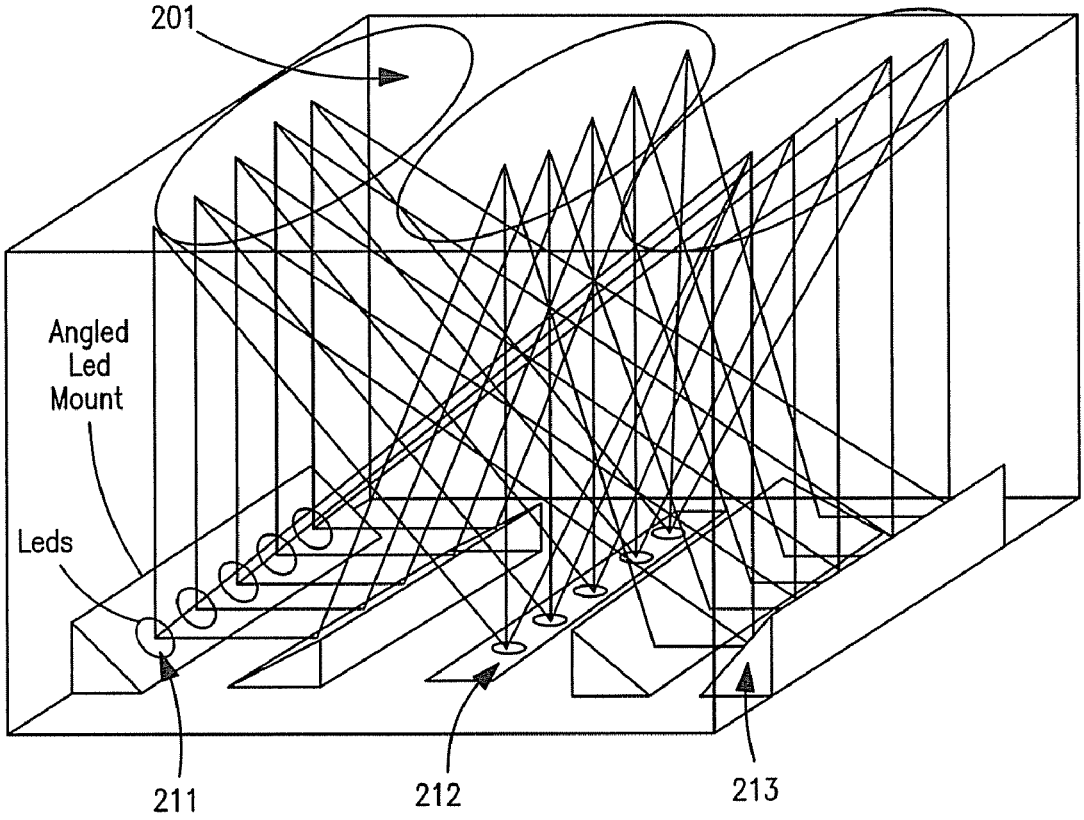
FIG. 4 is perspective schematic of a lighting fixture according to an alternate embodiment from that shown in FIG. 1.

Referring now to FIG. 4, another aspect of the present subject matter is disclosed. As is illustrated in FIG. 4, light-emitting devices can be provided that emit light having different wavelengths. For instance, first light-emitting devices 211 can emit light having a first wavelength (e.g. blue), second light-emitting devices 212 can emit light having a second wavelength (e.g. red), and third light-emitting devices 213 can emit light having a third wavelength (e.g. green). In this arrangement, the aggregate light formed from the combination of each of light-emitting devices 211, 212, 213 not only has a substantially uniform luminous intensity but an aggregate wavelength as well. For example, blue, red, and green LEDs can be provided as first, second, and third light-emitting devices 211, 212, and 213, respectively, to illuminate light diffuser 201 with an aggregate light having a wavelength of white light. Because colored LEDs are more widely available than white LEDs, this alternative embodiment of the present subject matter can be easily and cost-effectively manufactured.

In addition, by mixing the emissions from colored LEDs to produce white light, this embodiment of the present subject matter allows for the characteristics of the aggregate light to be easily manipulated. That is, by adjusting the luminous intensity of one or more of first, second, and third light-emitting devices 211, 212, and 213, the color warmth and chromaticity of the aggregate light can be thereby adjusted. For example, if the end user desires a light having a slightly yellow hue, the intensity of the blue LEDs can be decreased. In this way, a lighting fixture that more closely approximates the hue of an incandescent light can be achieved without requiring the fabrication of complex-material light-emitting device substrates.

This adjustment of the luminous intensity of one or more of the light-emitting devices can be accomplished by including terminals on the light-emitting devices that can be connected to a suitable adjustable power source for powering the light-emitting devices.

It will be understood that various details of the presently disclosed subject matter may be changed without departing from the scope of the presently disclosed subject matter. Furthermore, the foregoing description is for the purpose of illustration only, and not for the purpose of limitation.

What is claimed is:

1. A light-emitting diode (LED) lighting fixture comprising:

a light diffuser having a first surface and a second surface opposing the first surface; and a plurality of LEDs spaced apart from the light diffuser and configured to emit non-uniform light directly to the first surface of the light diffuser at predetermined angles, the non-uniform lights of each of the plurality of LEDs having a non-uniform luminous intensity;

wherein at least two of the LEDs are positioned at different angles with respect to one another so that the plurality of LEDs are operable to illuminate the first surface of the light diffuser with an aggregate light having a substantially uniform luminous intensity and the aggregate light passes through the light diffuser and out from the second surface to provide a substantially uniform luminous intensity light emission from the lighting fixture.

2. The LED lighting system according to claim 1, wherein the light diffuser has a curved shape.

3. A light-emitting diode (LED) lighting fixture comprising:

a light diffuser having a first surface and a second surface opposing the first surface; and a plurality of LEDs spaced apart from the light diffuser and configured to emit non-uniform light directly to the first surface of the light diffuser at predetermined angles, the non-uniform lights of each of the plurality of LEDs having a non-uniform luminous intensity;

wherein at least two of the LEDs are positioned at different angles with respect to one another so that the plurality of LEDs are operable to illuminate the first surface of the light diffuser with an aggregate light having a substantially uniform luminous intensity and the aggregate light passes through the light diffuser and out from the second surface to provide a substantially uniform luminous intensity light emission from the lighting fixture;

wherein the light diffuser has a curved shape; and wherein the first surface of the light diffuser has a concave shape and the second surface of the light diffuser has a convex shape.

4. A light-emitting diode (LED) lighting fixture comprising:

a light diffuser having a first surface and a second surface opposing the first surface; and a plurality of LEDs spaced apart from the light diffuser and configured to emit non-uniform light directly to the first surface of the light diffuser at predetermined angles, the non-uniform lights of each of the plurality of LEDs having a non-uniform luminous intensity;

wherein each of the plurality of LEDs has a viewing angle of at least 90°; and wherein at least two of the LEDs are positioned at different angles with respect to one another so that the plurality of LEDs are operable to illuminate the first surface of the light diffuser with an aggregate light having a substantially uniform luminous intensity and the aggregate light passes through the light diffuser and out from the second surface to provide a substantially uniform luminous intensity light emission from the lighting fixture.

5. The LED lighting system according to claim 4, wherein a maximum luminous intensity is emitted from each of the plurality of LEDs substantially at the center of the viewing angle.

6. The LED lighting system according to claim 1, comprising a lighting module, wherein the plurality of LEDs are positioned on the lighting module.

7. A light-emitting diode (LED) lighting fixture comprising:

a light diffuser having a first surface and a second surface opposing the first surface;

a plurality of LEDs spaced apart from the light diffuser and configured to emit non-uniform light directly to the first surface of the light diffuser at predetermined angles, the non-uniform lights of each of the plurality of LEDs having a non-uniform luminous intensity; and a lighting module, wherein the plurality of LEDs are positioned on the lighting module;

wherein at least two of the LEDs are positioned at different angles with respect to one another so that the plurality of LEDs are operable to illuminate the first surface of the light diffuser with an aggregate light having a substantially uniform luminous intensity and the aggregate light passes through the light diffuser and out from the second surface to provide a substantially uniform luminous intensity light emission from the lighting fixture; and wherein the lighting module comprises a contoured outer surface positioned to direct the non-uniform light emitted by the LEDs toward the light diffuser.

8. The LED lighting system according to claim 7, wherein each of the plurality of LEDs is positioned on the contoured outer surface of the lighting module such that each of the plurality of LEDs is oriented to direct light at a different angle.

9. A light-emitting diode (LED) lighting fixture comprising:

a light diffuser having a first surface and a second surface opposing the first surface;

a plurality of LEDs spaced apart from the light diffuser and configured to emit non-uniform light directly to the first surface of the light diffuser at predetermined angles, the non-uniform lights of each of the plurality of LEDs having a non-uniform luminous intensity; and one or more secondary diffusers positioned between the plurality of LEDs and the first surface of the light diffuser;

wherein at least two of the LEDs are positioned at different angles with respect to one another so that the plurality of LEDs are operable to illuminate the first surface of the light diffuser with an aggregate light having a substantially uniform luminous intensity and the aggregate light passes through the light diffuser and out from the second surface to provide a substantially uniform luminous intensity light emission from the lighting fixture.

10. The LED lighting system according to claim 9, wherein the secondary diffusers are aligned with a maximum luminous intensity of one or more of the plurality of LEDs.

11. The LED lighting fixture according to claim 1, wherein:

the plurality of LEDs comprises at least a first group of LEDs and a second group of LEDs, the non-uniform light emitted from the first group of LEDs having a first wavelength, and the non-uniform light emitted from the second group of LEDs having a second wavelength; and the aggregate light has a third wavelength or combination of wavelengths.

12. A light-emitting diode (LED) lighting fixture comprising:

a light diffuser having a first surface and a second surface opposing the first surface; and a plurality of LEDs spaced apart from the light diffuser and configured to emit non-uniform light directly to the first surface of the light diffuser at predetermined angles, the non-uniform lights of each of the plurality of LEDs having a non-uniform luminous intensity;

wherein at least two of the LEDs are positioned at different angles with respect to one another so that the plurality of LEDs are operable to illuminate the first surface of the light diffuser with an aggregate light having a substantially uniform luminous intensity and the aggregate light passes through the light diffuser and out from the second surface to provide a substantially uniform luminous intensity light emission from the lighting fixture wherein the plurality of LEDs comprises at least a first group of LEDs and a second group of LEDs, the non-uniform light emitted from the first group of LEDs having a first wavelength, and the non-uniform light emitted from the second group of LEDs having a second wavelength; and the aggregate light has a third wavelength or combination of wavelengths; and wherein the luminous intensity of one or more of the first group of LEDs and the second group of LEDs is adjustable to change the color warmth and chromaticity of the aggregate light.

13. A light-emitting diode (LED) lighting fixture comprising:

a light diffuser having a first surface and a second surface opposing the first surface; and a plurality of LEDs spaced apart from the light diffuser and configured to emit non-uniform light directly to the first surface of the light diffuser at predetermined angles, the non-uniform lights of each of the plurality of LEDs having a non-uniform luminous intensity;

wherein at least two of the LEDs are positioned at different angles with respect to one another so that the plurality of LEDs are operable to illuminate the first surface of the light diffuser with an aggregate light having a substantially uniform luminous intensity and the aggregate light passes through the light diffuser and out from the second surface to provide a substantially uniform luminous intensity light emission from the lighting fixture;

wherein the plurality of LEDs comprise at least a first group of LEDs, a second group of LEDs, and a third group of LEDs, and the non-uniform light emitted from the first group of LEDs having a first wavelength, and the non-uniform light emitted from the second and third groups of LEDs having a second and third wavelength, and the aggregate light having a fourth wavelength or combination of wavelengths.

14. The LED lighting fixture according to claim 13, wherein the luminous intensity of one or more of the first, second and third groups of LEDs is adjustable to change the color warmth and chromaticity of the aggregate light.

15. A light-emitting diode (LED) lighting fixture comprising:

a light diffuser having a first surface and a second surface opposing the first surface;

a plurality of LEDs configured to emit non-uniform light directly to the first surface of the light diffuser, the non-uniform lights of each of the plurality of LEDs having a non-uniform luminous intensity; and a lighting module spaced apart from the light diffuser, the plurality of LEDs being positioned on the lighting module, the lighting module comprising a contoured outer surface positioned to direct the non-uniform light emitted by the LEDs directly to the light diffuser at predetermined angles;

wherein each of the plurality of LEDs is positioned on the contoured outer surface of the lighting module such that each of the plurality of LEDs is oriented to direct light at a different angle; and wherein the LEDs are positioned with respect to one another so that the plurality of LEDs are operable to illuminate the first surface of the light diffuser with an aggregate light having a substantially uniform luminous intensity and the aggregate light passes through the light diffuser and out from the second surface to provide a substantially uniform luminous intensity light emission from the lighting fixture.

16. A light-emitting diode (LED) lighting fixture comprising:

a light diffuser having a first surface and a second surface opposing the first surface;

a plurality of LEDs spaced apart from the light diffuser and configured to emit non-uniform light directly to the first surface of the light diffuser at predetermined angles, the non-uniform lights of each of the plurality of LEDs having a non-uniform luminous intensity; and one or more secondary diffusers positioned between the plurality of LEDs and the first surface of the light diffuser;

wherein the LEDs are positioned at different angles with respect to one another so that the plurality of LEDs are operable to illuminate the first surface of the light diffuser with an aggregate light having a substantially uniform luminous intensity and the aggregate light passes through the light diffuser and out from the second surface to provide a substantially uniform luminous intensity light emission from the lighting fixture.

17. The LED lighting fixture according to claim 16, wherein the secondary diffusers are aligned with a maximum luminous intensity of one or more of the plurality of LEDs.

18. A light-emitting diode (LED) lighting fixture comprising:

a light diffuser; and a plurality of LEDs spaced apart from the light diffuser and configured to emit non-uniform light directly to the light diffuser at predetermined angles, each of the non-uniform lights having a non-uniform luminous intensity, the plurality of LEDs comprising at least a first group of LEDs and a second group of LEDs, the non-uniform light emitted from the first group of LEDs having a first wavelength, and the non-uniform light emitted from the second group of LEDs having a second wavelength;

wherein the LEDs are positioned at different angles with respect to one another so that the plurality of LEDs are operable to illuminate the light diffuser with an aggregate light having a substantially uniform luminous intensity and the aggregate light passes through the light diffuser and out from a surface to provide a substantially uniform luminous intensity light emission from the lighting fixture, the aggregate light having a third wavelength or combination of wavelengths.

19. The LED lighting fixture according to claim 18, wherein the luminous intensity of one or more of the first group of LEDs and the second group of LEDs is adjustable to change the color warmth and chromaticity of the aggregate light.

20. The LED lighting fixture according to claim 18, wherein the plurality of LEDs comprise at least a first group of LEDs, a second group of LEDs, and a third group of LEDs, and the non-uniform light emitted from the first group of LEDs having a first wavelength, and the non-uniform light emitted from the second and third groups of LEDs having a second and third wavelength, and the aggregate light having a fourth wavelength or combination of wavelengths.

21. The LED lighting fixture according to claim 20, wherein the luminous intensity of one or more of the first, second and third groups of LEDs is adjustable to change the color warmth and chromaticity of the aggregate light.

22. A light-emitting diode (LED) lighting fixture comprising:

a light diffuser having a first surface and a second surface opposing the first surface; and a plurality of LEDs operable to emit non-uniform light in a direction toward the first surface of the light diffuser, each of the non-uniform lights having a non-uniform luminous intensity, the plurality of LEDs comprising at least a first group of LEDs, a second group of LEDs, and a third group of LEDs, and the non-uniform light emitted from the first group of LEDs having a first wavelength, and the non-uniform light emitted from the second and third groups of LEDs having a second and third wavelength, and the aggregate light having a fourth wavelength or combination of wavelengths;

wherein at least two of the LEDs are positioned at different angles with respect to one another so that the plurality of LEDs serves to illuminate the first surface of the light diffuser with an aggregate light having a substantially uniform luminous intensity and the aggregate light passes through the light diffuser and out from the second surface to provide a substantially uniform luminous intensity light emission from the lighting fixture.

23. The LED lighting fixture according to claim 22, wherein the luminous intensity of one or more of the first, second and third groups of LEDs is adjustable to change the color warmth and chromaticity of the aggregate light.

24. A light-emitting diode (LED) lighting fixture comprising:

a light diffuser having a first surface and a second surface opposing the first surface; and a plurality of LEDs operable to emit non-uniform light in a direction toward the first surface of the light diffuser, each of the non-uniform lights having a non-uniform luminous intensity, the plurality of LEDs comprising at least a first group of LEDs, a second group of LEDs, and a third group of LEDs, the non-uniform light emitted from the first group of LEDs having a first wavelength, and the non-uniform light emitted from the second and third groups of LEDs having a second and third wavelength;

wherein the LEDs are positioned with respect to one another so that the plurality of LEDs serves to illuminate the first surface of the light diffuser with an aggregate light having a substantially uniform luminous intensity and the aggregate light passes through the light diffuser and out from the second surface to provide a substantially uniform luminous intensity light emission from the lighting fixture, the aggregate light having a fourth wavelength or combination of wavelengths.

25. The LED lighting fixture according to claim 24, wherein the luminous intensity of one or more of the first, second and third groups of LEDs is adjustable to change the color warmth and chromaticity of the aggregate light.

26. A light-emitting diode (LED) lighting fixture comprising:

a light diffuser having a first surface and a second surface opposing the first surface;

a plurality of LEDs spaced apart from the light diffuser and configured to emit non-uniform light in a direction toward the first surface of the light diffuser, the non-uniform light of each of the plurality of LEDs having a non-uniform luminous intensity;

the plurality of LEDs positioned at different predetermined angles such that the lighting fixture simulates the appearance of an omni-directional, non-LED bulb.

27. The LED lighting fixture according to claim 26, wherein the light diffuser has a curved shape.

28. The LED lighting fixture according to claim 26, wherein the plurality of LEDs are positioned on a lighting module and the lighting module is centrally located with respect to the light diffuser.

29. The LED lighting fixture according to claim 26, wherein at least two of the LEDs are positioned at different angles with respect to one another so that the plurality of LEDs serves to illuminate the first surface of the light diffuser with an aggregate light having a substantially uniform luminous intensity and the aggregate light passes through the light diffuser and out from the second surface to provide a substantially uniform luminous intensity light emission from the lighting fixture.

30. The LED lighting system according to claim 1, wherein the plurality of LEDs are centrally located with respect to the light diffuser.

31. The LED lighting system according to claim 18, wherein the plurality of LEDs are centrally located with respect to the light diffuser.

* * * * *